US009567703B2

(12) United States Patent
Wright et al.

(10) Patent No.: US 9,567,703 B2
(45) Date of Patent: Feb. 14, 2017

(54) NOZZLE ASSEMBLY WITH MULTIPLE SPRAY CURVATURES AND AIR-LOCK RELEASE GEOMETRY

(71) Applicant: General Electric Company, Schenectady, NY (US)

(72) Inventors: Troy Marshall Wright, Louisville, KY (US); Wayne E. Lawson, La Grange, KY (US); Torri Lynn Tanner, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 93 days.

(21) Appl. No.: 14/507,893

(22) Filed: Oct. 7, 2014

(65) Prior Publication Data

US 2016/0097150 A1 Apr. 7, 2016

(51) Int. Cl.

| | |
|---|---|
| ***D06F 39/08*** | (2006.01) |
| *D06F 39/12* | (2006.01) |
| *D06F 23/04* | (2006.01) |

(52) U.S. Cl.

CPC ..... *D06F 39/088* (2013.01); *D06F 39/08* (2013.01); *D06F 39/083* (2013.01); *D06F 23/04* (2013.01); *D06F 39/12* (2013.01)

(58) Field of Classification Search

CPC ..... D06F 39/08; D06F 39/083; D06F 39/088
See application file for complete search history.

(56) References Cited

U.S. PATENT DOCUMENTS

| | | | | |
|---|---|---|---|---|
| 2,481,979 | A * | 9/1949 | Colley | D06F 39/10 210/314 |
| 3,466,902 | A * | 9/1969 | Akers | D06F 39/088 137/801 |
| 3,605,455 | A * | 9/1971 | Olthuis | D06F 39/088 137/216 |
| 3,663,975 | A * | 5/1972 | Fish | D06F 39/088 68/23.5 |
| 4,754,622 | A * | 7/1988 | Fanson | D06F 39/088 239/523 |
| 5,031,426 | A * | 7/1991 | Wilson | D06F 39/083 239/593 |
| 2005/0273945 | A1* | 12/2005 | Zaccone | D06F 39/088 8/159 |
| 2007/0067920 | A1* | 3/2007 | Zaccone | D06F 25/00 8/158 |
| 2007/0107471 | A1* | 5/2007 | Zaccone | D06F 25/00 68/3 R |
| 2010/0064444 | A1* | 3/2010 | Nieh | D06F 13/00 8/158 |
| 2012/0240638 | A1* | 9/2012 | Hettinger | D06F 39/088 68/200 |
| 2014/0014211 | A1 | 1/2014 | Ritchie, Jr. | |

FOREIGN PATENT DOCUMENTS

| | | |
|---|---|---|
| CN | 2612698 | 4/2004 |

* cited by examiner

*Primary Examiner* — Joseph L Perrin
(74) *Attorney, Agent, or Firm* — Dority & Manning, P.A.

(57) ABSTRACT

A washing machine appliance having an integrated nozzle and valve body assembly for dispensing fluids to a wash basket of the washing machine appliance is provided. The nozzle assembly also includes features for evenly dispensing fluids the wash basket and for preventing moisture intrusion into the cabinet of the washing machine appliance. The nozzle assembly further includes features for preventing fluid entrapment in the nozzle assembly.

9 Claims, 7 Drawing Sheets

NOZZLE ASSEMBLY WITH MULTIPLE SPRAY CURVATURES AND AIR-LOCK RELEASE GEOMETRY

FIELD OF THE INVENTION

The subject matter of the present disclosure relates generally to washing machine appliances.

BACKGROUND OF THE INVENTION

Washing machine appliances generally form wash and rinse fluids to clean clothing articles disposed within a wash basket of the appliance. The wash and rinse fluids can be formed in a wash tub of a washing machine appliance and can include water and various fluid additives such as, e.g., detergent, fabric softener, and/or bleach. The wash and rinse fluids are typically dispensed to the wash basket through one or more nozzles during certain periods of the wash and rinse cycles. However, air may become trapped in a typical nozzle such that not all of the fluid introduced into the nozzle is dispensed during the allotted period of time. Thus, if the trapped air dissipates during the remainder of the wash or rinse cycle, the fluid retained in the nozzle could flow to the wash basket during undesirable periods of the wash or rinse cycles.

Also, fluid dispensing nozzles for washing machine appliances are generally formed as one or more parts, and one or more valves are assembled with the nozzles to control fluid flow through the nozzle. The assembly of the nozzle and the valves requires hoses, clamps, and the like, which have the potential to leak. Moreover, the use of multiple component parts increases the materials and manufacturing costs of the washing machine appliance, as more parts require more labor and time to assemble.

Further, washing machine appliances may dispense a volume of fluid to a load of articles in the wash basket to sense, e.g., the load size, the type of articles (such as, e.g., cotton, synthetic, or a blend of cotton and synthetic) within the load, and/or whether the articles were wet when loaded into the wash basket. To accurately sense, e.g., the size of the load of articles, the volume of fluid preferably is evenly dispensed to the load of articles. Also, rinse fluids are preferably evenly dispensed to the articles in the wash basket to adequately rinse the load of articles. However, typical nozzles for dispensing fluid to the wash basket have a narrow range of distribution of the fluid to the wash basket, which can hinder accurate wet load sensing and inadequately distribute fluid for rinse cycles of the washing machine.

Additionally, fluid dispensing nozzles typically are installed through an opening in a top panel or a portion of the cabinet of the washing machine appliance and are positioned to spray fluid into the wash basket. Fluid, such as, e.g., water vapor or splash, that escapes through the opening for the nozzle and into the cabinet could harm components positioned within the cabinet or could leak onto the floor beneath the washing machine appliance. Thus, fluid preferably should be prevented from passing around the nozzle and through the opening in which the nozzle is installed.

Accordingly, a washing machine appliance having an integrated nozzle and valve body assembly for dispensing fluids to the wash basket of the washing machine would be beneficial. In addition, a nozzle assembly for a washing machine appliance that evenly dispenses fluid to a wash basket of the washing machine appliance would be useful. Further, a nozzle assembly with features for preventing moisture intrusion into the cabinet of the washing machine appliance and for preventing fluid entrapment in the nozzle assembly would be advantageous.

BRIEF DESCRIPTION OF THE INVENTION

The present subject matter provides a washing machine appliance having an integrated nozzle and valve body assembly for dispensing fluids to a wash basket of the washing machine appliance. The nozzle assembly also includes features for evenly dispensing fluids the wash basket and for preventing moisture intrusion into the cabinet of the washing machine appliance. The nozzle assembly further includes features for preventing fluid entrapment in the nozzle assembly. Additional aspects and advantages of the invention will be set forth in part in the following description, or may be apparent from the description, or may be learned through practice of the invention.

In a first exemplary embodiment, a washing machine appliance defining a vertical direction, a lateral direction, and a transverse direction that are perpendicular to each other is provided. The washing machine appliance includes a cabinet; a wash tub located within the cabinet; a wash basket rotatably mounted within the wash tub; a top panel defining a first opening for access to the wash basket, the top panel further defining a second opening adjacent a back portion of the cabinet; and a nozzle for providing fluid to the wash basket. The nozzle includes a top member defining at least one valve body; and a bottom member defining a plurality of apertures in a curved surface of the bottom member. The curved surface is curved in a plurality of planes such that the apertures are defined in a plurality of planes.

In a second exemplary embodiment, a washing machine appliance defining a vertical direction, a lateral direction, and a transverse direction that are perpendicular to each other is provided. The washing machine appliance includes a cabinet; a wash tub located within the cabinet; a wash basket rotatably mounted within the wash tub; a top panel defining a first opening for access to the wash basket, the top panel further defining a second opening adjacent a back portion of the cabinet; and a nozzle for providing fluid to the wash basket. The nozzle includes a top member defining at least one valve body; and a bottom member defining at least one straw vent extending from the bottom member toward the top member. The straw vent provides fluid communication between an interior and an exterior of the nozzle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same reference numerals in different figures denotes the same or similar features.

DETAILED DESCRIPTION

Figure 1:
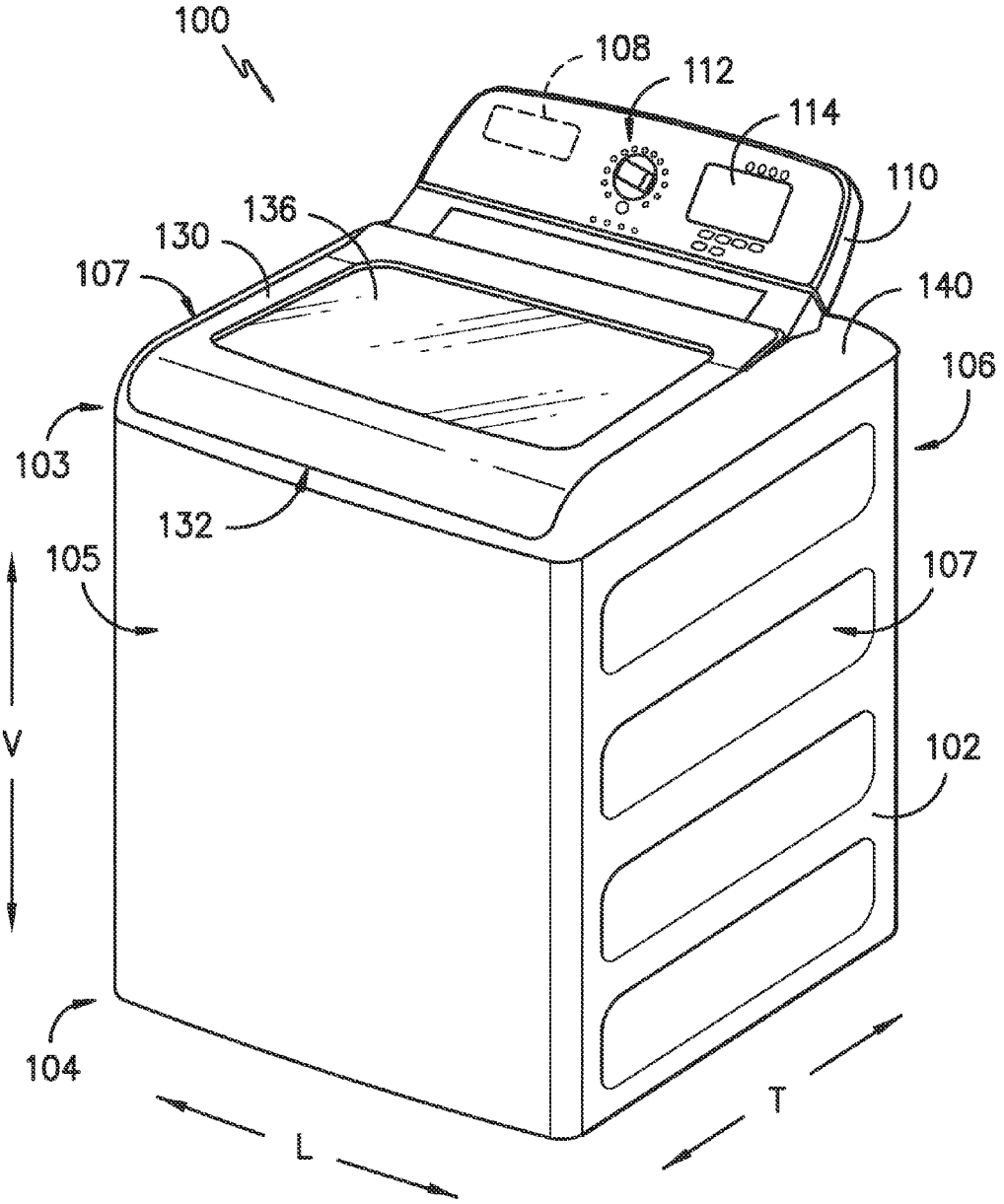
FIG. 1 illustrates an exemplary embodiment of a washing machine appliance of the present invention with a door shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
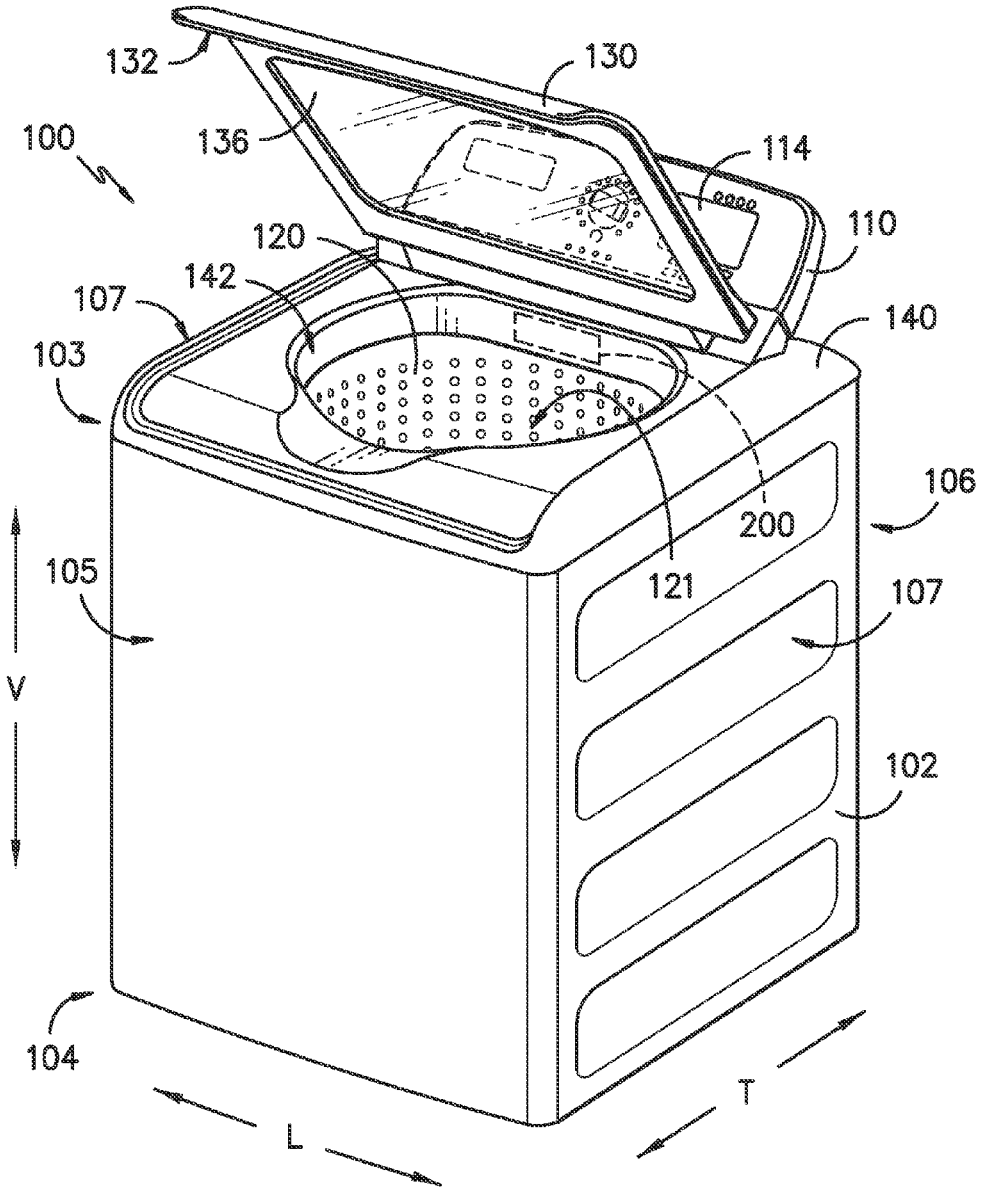
FIG. 2 illustrates the exemplary embodiment of a washing machine shown in FIG. 1 except with the door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V, a front 105 and a back 106 along a transverse direction T, and opposing sides 107 along a lateral direction L. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) having a tub cover 122, and wash basket 120 is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines a first opening 142 (FIG. 2) that permits user access to wash basket 120 of wash tub 121. Door 130, rotatably mounted to top panel 140, permits selective access to opening 142; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any outer suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

Top panel 140 may include a fluid additive dispenser (not shown) for receipt of one or more fluid additives, e.g., detergent, fabric softener, and/or bleach. The dispenser could be positioned at a vertical location above wash tub 121 near back panel 106 of cabinet 102, but the dispenser could be positioned in other locations as well. Multiple fluid additive dispensers could be used as well.

Figure 3:
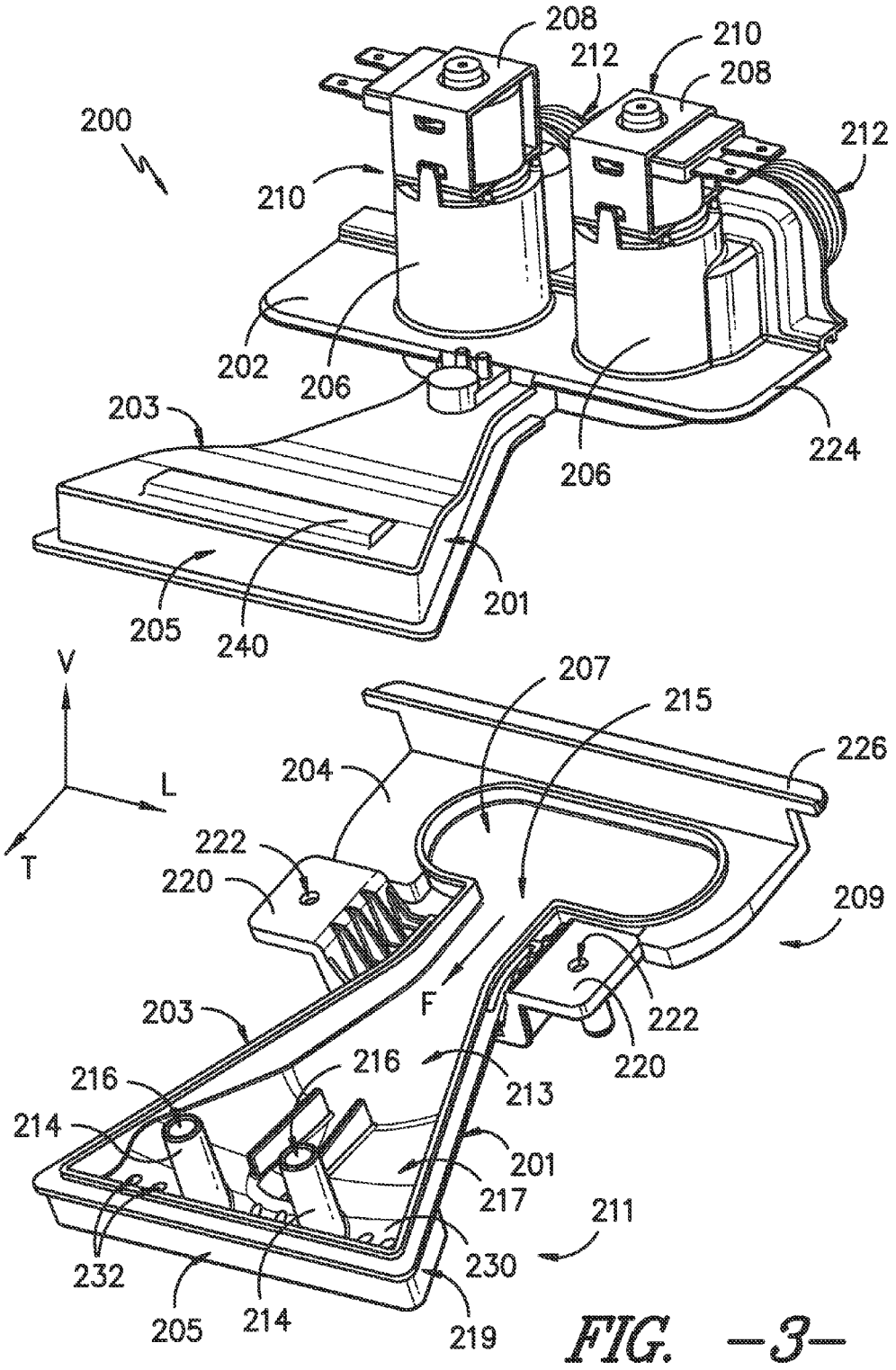
FIG. 3 illustrates an exemplary embodiment of a nozzle assembly of the present subject matter.

In an illustrative embodiment, laundry items are loaded into wash basket 120 through first opening 142, and washing operation is initiated through operator manipulation of input selectors 112. Wash basket 120 is filled with water and detergent and/or other fluid additives from, e.g., the fluid additive dispenser and/or a nozzle assembly 200, to form wash and rinse fluids. As shown in FIG. 3, one or more valves can be arranged with nozzle assembly 200 to provide for filling wash basket 120 with fluid to the appropriate level for the amount of articles being washed and/or rinsed. Nozzle assembly 200 is described in greater detail below.

By way of example for a wash mode, once wash basket 120 is properly filled with fluid, the contents of wash basket 120 can be agitated (e.g., with an impeller as discussed previously) for washing of laundry items in wash basket 120. After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through first opening 142.

While described in the context of a specific embodiment of washing machine appliance 100, using the teachings disclosed herein it will be understood that washing machine appliance 100 is provided by way of example only. Other washing machine appliances having different configurations (such as horizontal-axis washing machine appliances), different appearances, and/or different features may be utilized with the present subject matter as well.

FIG. 3 illustrates an exemplary embodiment of nozzle assembly 200. As shown, nozzle assembly 200 includes a top member 202 and a bottom member 204. Top member 202 and bottom member 204 each include a first side 201, a second side 203, and a front portion 205. Top member 202 and bottom member 204 are injection molded and welded together to form nozzle assembly 200. In alternative embodiments, top and bottom members 202, 204 may be formed and joined by any appropriate means. When joined, top member 202 and bottom member 204 defined a chamber 207 having an inlet end 209 and an outlet end 211. A neck portion 213 connects inlet end 209 and outlet end 211 of chamber 207. As shown in FIG. 3, in some embodiments, neck portion 213 may include a first end 215 that is narrower than a second end 217. That is, neck portion 213 may widen from first end 215 to second end 217 such that the width of first 215 is less than the width of second end 217.

Top member 202 defines valve bodies 206, i.e., valve bodies 206 are molded as a portion of top member 202, and thus, valve bodies 206 are integral with nozzle assembly 200. The exemplary embodiment of nozzle assembly 200 includes two valve bodies 206, but alternatively, one, three, or more than three valve bodies could be defined by top member 202. Further, an armature assembly (not shown) is spun-weld at each valve body 206, and an electrical valve coil 208 is installed over the stem of an armature guide of each armature assembly; together, an armature assembly, an electrical valve coil 208, and a valve body 206 form a valve 210. Because valve bodies 206 are molded as part of top member 202, no hoses, clamps, or the like are required to join valves 210 and nozzle assembly 200, such that potential leak points between valves 210 and nozzle assembly 200 are eliminated. In addition, the cost of hoses, clamps, and the like, as well as the assembly costs due to the use of such components, are eliminated.

Top member 202 also defines fluid inlets 212, which provide a flow of fluid to valves 210. In turn, valves 210 control the flow of fluid to nozzle assembly 200, from which the fluid flow is provided to wash basket 120. Top member 202 may define a number of fluid inlets 212 equal to the number of valves 210, such that one fluid inlet 212 provides a flow of fluid to one valve 210. In other embodiments, the number of fluid inlets 212 may be less than or greater than the number of valves 210.

Figure 6:
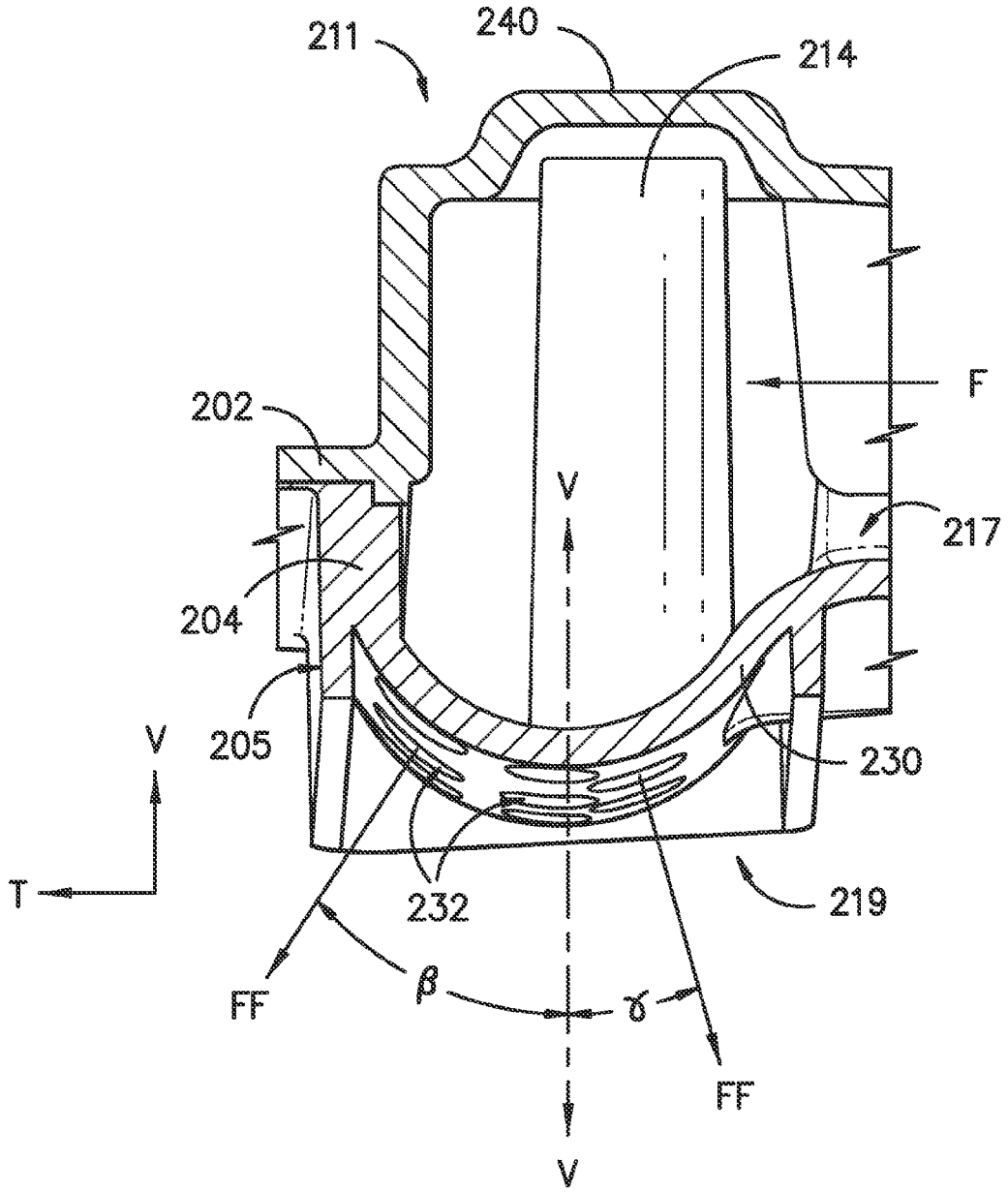
FIG. 6 provides a cross-section view in a second plane of the exemplary nozzle assembly of FIG. 3.

For a period of time during a wash and/or rinse cycle of washing machine 100, fluid may be introduced into nozzle assembly 200 through valves 210. Through valves 210, fluid may enter chamber 207 at inlet end 209 and flow in a flow direction F toward outlet end 211. Flow direction F is approximately parallel to an overall direction of fluid flow through nozzle assembly 200 and may be generally along the transverse direction T (FIG. 6). Outlet end 211 may define a plurality of apertures 232 (FIG. 4), described more fully below, through which the flow of fluid flows from nozzle assembly 200 to wash basket 120. After fluid ceases to be introduced into nozzle assembly 200, air may become trapped in nozzle assembly 200, which can inhibit the release of residual fluid flow through apertures 232 such that not all fluid introduced into nozzle assembly 200 may exit through apertures 232.

As shown in FIG. 3, bottom member 204 defines straw vents 214, which are configured to release air that becomes trapped in nozzle assembly 200 and thereby allow any residual fluid in nozzle assembly 200 to exit through apertures 232. Although shown with two straw vents 214, any appropriate number of straw vents may be provided, such as, e.g., one, three, or more than three straw vents. Straw vents 214 are generally columnar or cylindrical in shape and extend within chamber 207 from curved surface 230 toward top member 202. In an exemplary embodiment, top member 202 defines a hump 240 to capture air trapped in nozzle assembly 200 in a consistent location, and straw vents 214 extend into an area of chamber 207 defined by hump 240 (FIG. 5) such that any air trapped in the area of chamber 207 defined by hump 240 may be released through straw vents 214. Straw vents 214 may also have other configurations with respect to nozzle assembly 200.

Further, each straw vent 214 includes a straw inlet 216 and a straw outlet 218 (FIG. 4) at opposing ends of a fluid passageway defined by the straw vent. Straw inlets 216 are positioned at a vertical distance above straw outlets 218 within chamber 207; as shown in FIG. 5, in an exemplary embodiment, straw inlets 216 are positioned in the area of chamber 207 defined by hump 240. Straw inlets 216 are open to the interior of nozzle assembly 200, and straw outlets 218 are open to the exterior of nozzle assembly 200. In this way, straw vents 214 provide fluid communication between the interior and exterior of nozzle assembly 200 to vent air trapped in nozzle assembly 200 and force fluid from nozzle assembly 200 as described. However, other configurations of straw vents 214, including a different number, height, shape, and location of vents 214, may be used as well.

Bottom member 204 also defines plates 220 for attaching nozzle assembly 200 to top panel 140 or to any other appropriate support, such as, e.g., cabinet 102 of washing machine appliance 100. Plates 220 may define apertures 222 to receive any appropriate fastener, such as, e.g., screws or the like, used to attach nozzle assembly 200 to washing machine appliance 100. Moreover, while bottom member 204 is illustrated with two plates 220, each plate defining one aperture 222, other numbers and configurations of plates 220 and apertures 222 may be used as well.

Figure 7:
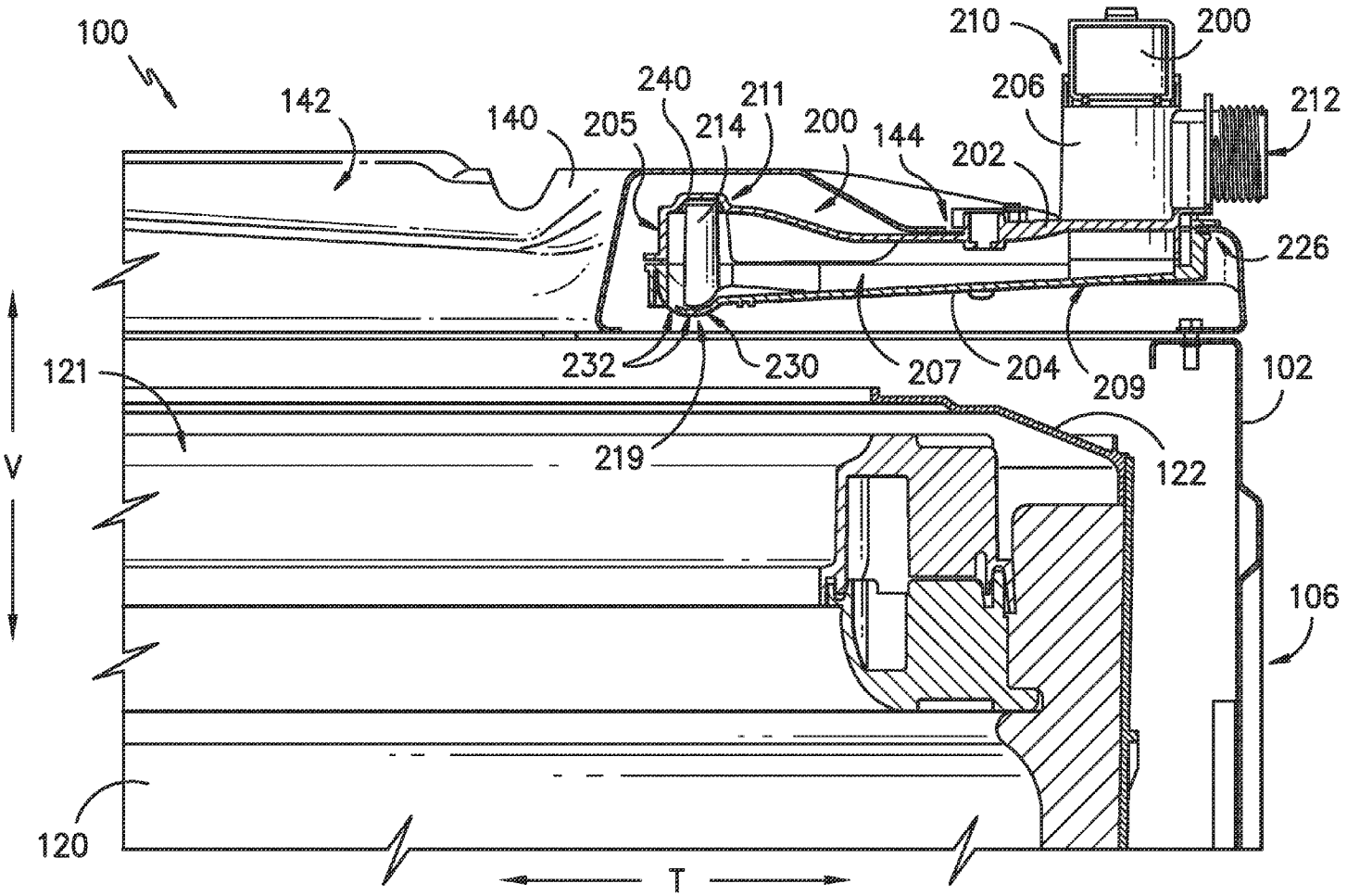
FIG. 7 provides a cross-section view of a portion of an exemplary embodiment of a washing machine appliance with a nozzle assembly of the present subject matter installed therein.

Further, top member 202 defines a top lip 224 around the inlet end 209 of top member 202. Additionally, bottom member 204 defines a bottom lip 226 that fits over the portion of second opening 144 adjacent the back 106 of washing machine appliance 100 to assist in attaching nozzle assembly 200 to appliance 100. As shown in FIGS. 3 and 7, lips 224, 226 may be configured to provide a seal between nozzle assembly 200 and top panel 140 such that water vapor, fluid splash, and the like cannot pass through second opening 144, outside of nozzle assembly 200, and into cabinet 102 of appliance 100. As such, lips 224, 226 may be shaped and/or have a surface area sufficient to seal second opening 144 against moisture intrusion.

As further illustrated in FIG. 3, bottom member 204 includes a nozzle outlet 219 for the exit of fluid from nozzle assembly 200. Nozzle outlet 219 is defined at outlet end 211 of nozzle assembly 200. Nozzle outlet 219 defines a curved surface 230; curved surface 230 is shown in greater detail in FIGS. 4, 5, and 6.

Figure 4:
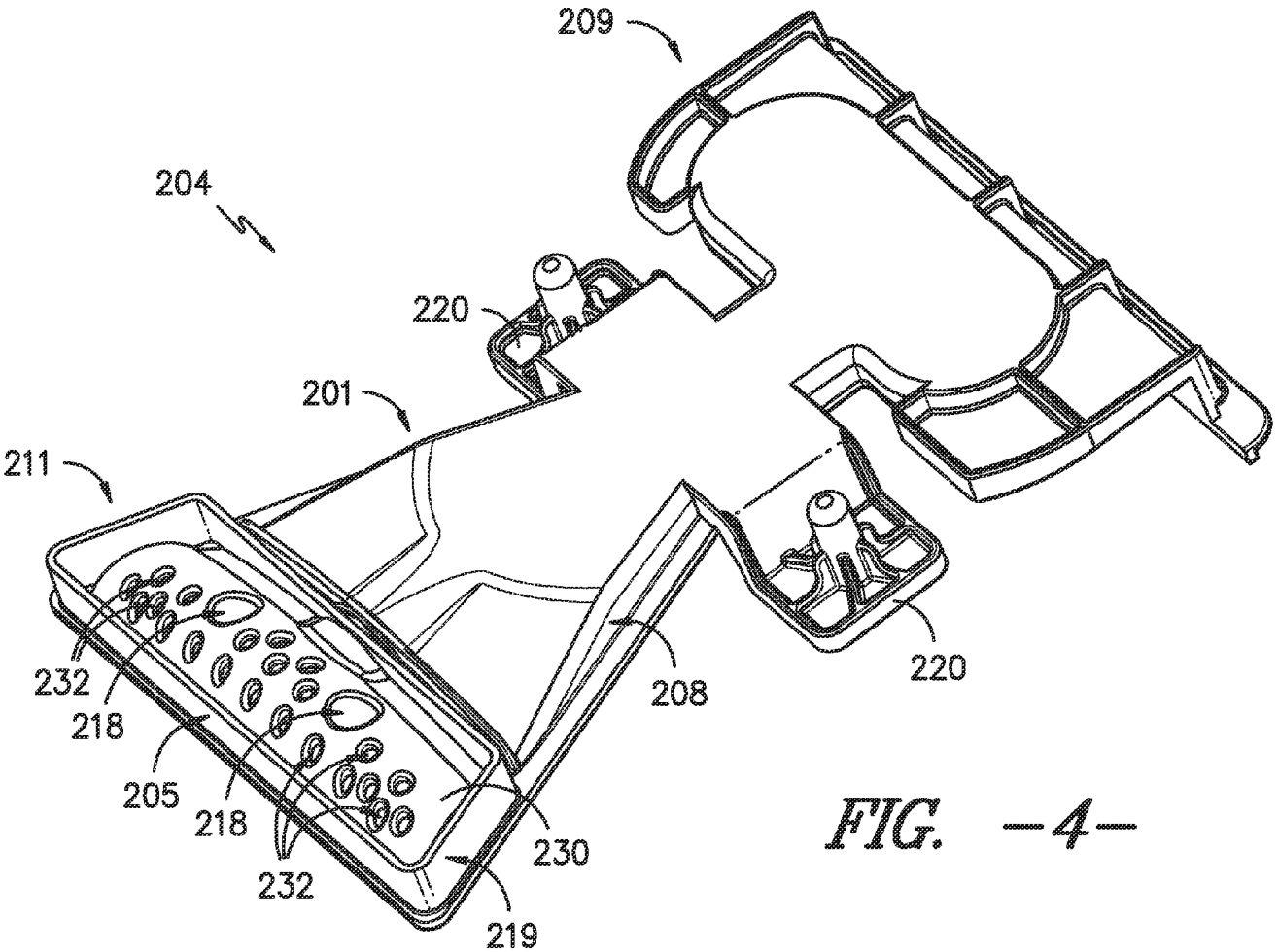
FIG. 4 provides a bottom perspective view of the bottom member of the exemplary nozzle assembly of FIG. 3.
Figure 5:
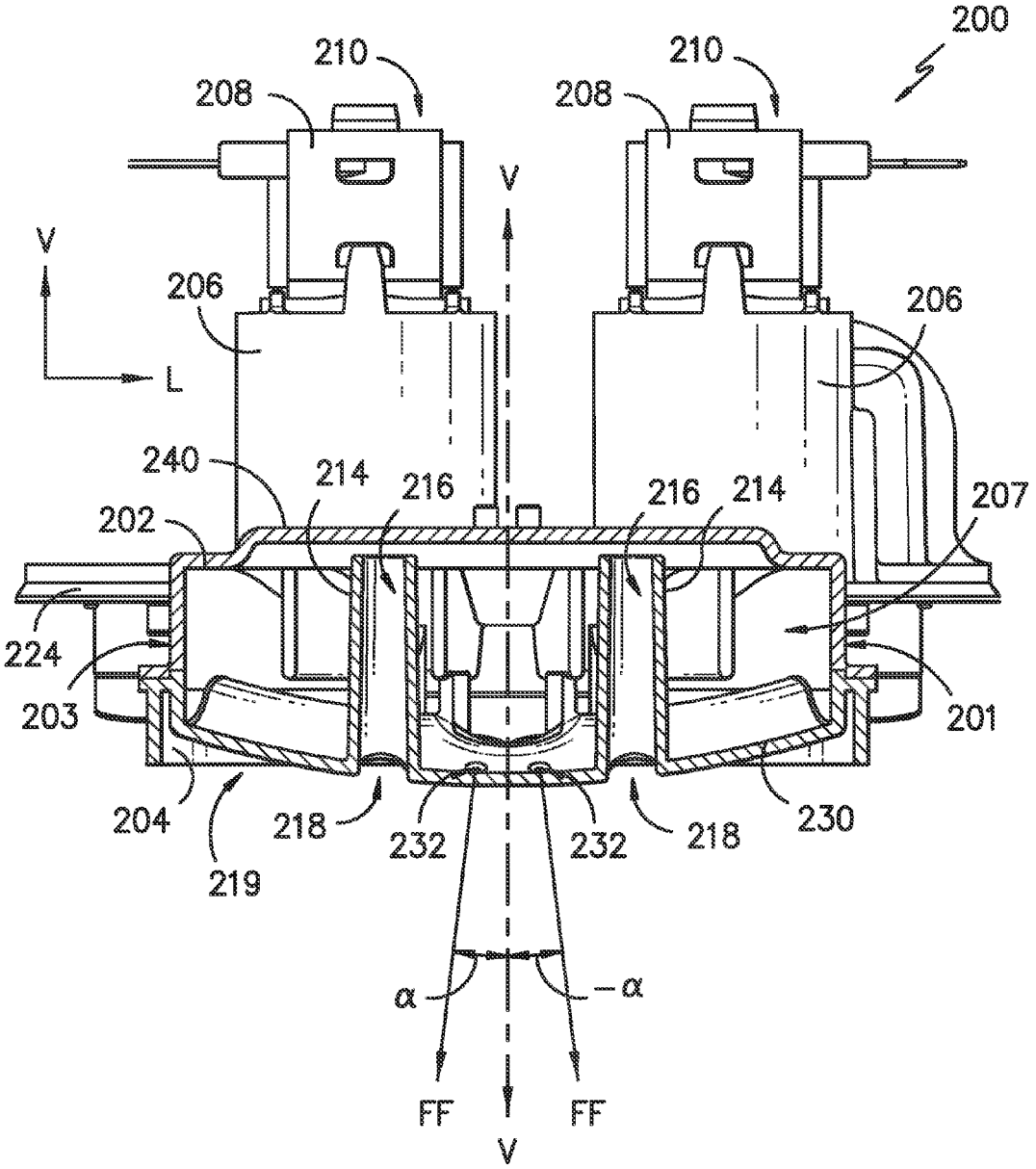
FIG. 5 provides a cross-section view in a first plane of the exemplary nozzle assembly of FIG. 3.

FIG. 4 provides a bottom perspective view of bottom member 204 of nozzle assembly 200. As shown, curved surface 230 defines straw outlets 218 of the cylindrically shaped straw vents 216. Each straw outlet 218 has a diameter, and the diameter of one outlet 218 may or may not be equal to the other outlet 218. Further, curved surface 230 defines a plurality of apertures 232 to allow fluid introduced into nozzle assembly 200 to flow to wash basket 120. Each aperture 232 has a diameter, and the diameter of each aperture 232 may be equal, or the diameters of a portion of apertures 232 may be equal. In other embodiments, each aperture 232 may have a different diameter. Moreover, the diameter of apertures 232 may be less than the diameter of straw outlets 218 as illustrated in FIG. 4, or in alternative embodiments, the diameters of apertures 232 may be greater than or equal to the diameters of outlets 218. In other embodiments, apertures 232 may have other shapes and/or sizes, and the shape and/or size of apertures 232 may be selected to optimize the flow rate of fluid from nozzle assembly 200 and/or to optimize the fluid coverage provided to laundry articles in wash basket 120.

Also as illustrated in FIG. 4, curved surface 230 is curved in multiple planes. FIG. 5 provides a cross-section of nozzle assembly 200 through nozzle outlet 219 along a first plane that includes the vertical direction V and the lateral direction L. As shown, curved surface 230 of bottom member 204 is curved within the first plane and any plane parallel to the first plane drawn through curved surface 230, which extends from front portion 205 to the second end 217 of neck portion 213 (FIG. 6). That is, curved surface 230 is curved along a direction orthogonal to the flow direction F.

FIG. 6 provides a cross-section of a portion of nozzle assembly 200 along a second plane that includes the vertical direction V and the transverse direction T. As illustrated, curved surface 230 of bottom member 204 is curved within the second plane and any plane parallel to the second plane drawn through curved surface 230, which extends between first side 201 and second side 203 (FIG. 5). That is, curved surface 230 is curved along the flow direction F. Curved surface 230 may have a different radius of curvature along each direction and in each plane as shown. In other embodiments, curved surface 230 may have the same radius of curvature along each direction and in each plane. Curved surface 230 may have other shapes as well.

Accordingly, curved surface 230 is curved within multiple planes and, thus, apertures 232 are defined in multiple planes such that the fluid flow FF from nozzle assembly 200 to wash basket 120 is at a plurality of angles to the vertical direction V, which is parallel to the z axis of the Cartesian coordinate system shown in FIGS. 5 and 6. As illustrated in FIGS. 5 and 6, a portion of fluid flow FF is at an angle $\alpha$ to the z axis, a portion is at an angle $-\alpha$ to the z axis, a portion is at an angle $\beta$ to the z axis, and another portion is at an angle $\gamma$ to the z axis. Angle $\alpha$ may be between about $-30°$ and about 30°, angle $\theta$ may be between about 0° and about 45", and angle $\gamma$ may be between about $-30°$ and about 0°. In other embodiments, angles $\alpha$, $\beta$, and $\gamma$ may have other values, generally between approximately $-90°$ and approximately 90°, depending on the location of apertures 232 on curved surface 230. Other design constraints and considerations may also limit the values of $\alpha$, $\beta$, and $\gamma$ to a smaller range, e.g., from about $-60°$ to approximately 60°.

As a result of the geometry of curved surface 230 and the location of apertures 232, the flow of fluid FF from nozzle assembly 200 may be more widely distributed within wash basket 120. By more widely distributing the fluid flow FF, nozzle assembly 200 provides a more even fluid coverage of articles within wash basket 120, which can improve wet load sensing and spray rinse performance of washing machine appliance 100.

FIG. 7 provides a cross-section view of a portion of an exemplary embodiment of washing machine appliance 100 and nozzle assembly 200 of the present subject matter. As shown, nozzle assembly 200 is installed in second opening 144 of top panel 140, where second opening 144 is adjacent back 106 of cabinet 102. Bottom lip 226 is positioned against top panel 140 to support nozzle assembly 200 and to prevent moisture intrusion into cabinet 102.

Nozzle outlet 219 of nozzle assembly 200 is spaced apart from back 106 along the transverse direction T to minimize splash on tub cover 122 and cabinet 102 from fluid flowing through apertures 232 of curved surface 230. Spacing nozzle outlet 219 from back 106 of cabinet 102 also assists in evenly dispensing fluid to wash basket 120. As described above, apertures 232 may be located on curved surface 230 such that fluid flow FF through apertures 232 may vary from approximately parallel the vertical direction V to approximately parallel the lateral direction L and the transverse direction T. By spacing nozzle outlet 219, which defines curved surface 230 and apertures 232, from back 106 of cabinet 102, more area within wash basket 120 may be within the trajectory of fluid flow from nozzle assembly 200. Accordingly, fluid may be more evenly dispensed to wash basket 120 such that any laundry articles within wash basket 120 are more evenly covered with fluid.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A washing machine appliance defining a vertical direction, a lateral direction, and a transverse direction that are perpendicular to each other, the washing machine appliance comprising:

a cabinet defining a front, back, and opposing sides, the front spaced apart from the back along the transverse direction, the opposing sides spaced apart along the lateral direction;

a wash tub located within the cabinet;

a wash basket rotatably mounted within the wash tub;

a top panel defining a first opening for access to the wash basket; and a nozzle assembly for providing fluid to the wash basket, the nozzle assembly comprising a top member defining at least one valve body, and a bottom member defining a plurality of apertures in a curved surface of the bottom member, the curved surface being curved in more than one plane such that the apertures are defined in more than one plane, the bottom member further defining at least one straw vent extending from the bottom member toward the top member.

2. The washing machine appliance of claim 1, wherein the straw vent has an inlet and an outlet, and wherein the inlet is positioned at a vertical distance above the outlet.

3. The washing machine appliance of claim 1, wherein the nozzle assembly is installed in a second opening of the top panel adjacent the back of the cabinet.

4. The washing machine appliance of claim 1, wherein the top member further defines a top lip and the bottom member further defines a bottom lip, the top and bottom lips configured to provide a seal between the nozzle assembly and the top panel of the washing machine appliance when the nozzle assembly is installed in a second opening of the top panel.

5. The washing machine appliance of claim 1, wherein the bottom member further defines at least one plate for attaching the nozzle assembly to the top panel.

6. The washing machine appliance of claim 1, further comprising an electrical valve coil installed in each valve body of the top member.

7. The washing machine appliance of claim 1, wherein the curved surface is curved along a flow direction and along a direction orthogonal to the flow direction, wherein the flow direction is parallel to an overall direction of fluid flow through the nozzle assembly.

8. A washing machine appliance defining a vertical direction, a lateral direction, and a transverse direction that are perpendicular to each other, the washing machine appliance comprising:

a cabinet defining a front, back, and opposing sides, the front spaced apart from the back along the transverse direction, the opposing sides spaced apart along the lateral direction;

a wash tub located within the cabinet;

a wash basket rotatably mounted within the wash tub;

a top panel defining a first opening for access to the wash basket; and a nozzle assembly for providing fluid to the wash basket, the nozzle assembly defining a chamber having an inlet end, and outlet end, and a neck portion connecting the inlet end and the outlet end, the nozzle assembly comprising a top member defining at least one valve body, and a bottom member defining a plurality of apertures in a curved surface of the bottom member, the curved surface being curved in a first plane orthogonal to a flow direction and any plane parallel to the first plane through which the curved surface extends, the curved surface being curved in a second plane parallel to the flow direction and any plane parallel to the second plane through which the curved surface extends, wherein the bottom member of the nozzle assembly further defines at least one straw vent extending from the bottom member toward the top member.

9. The washing machine appliance of claim 8, wherein the apertures are defined in the curved surface such that the apertures are defined in more than one plane.

* * * * *